US009896160B2

(12) United States Patent
Pedersen et al.

(10) Patent No.: US 9,896,160 B2
(45) Date of Patent: Feb. 20, 2018

(54) MOON POOL CONTROL DEVICE FOR A MARINE VESSEL

(71) Applicant: Seastate 7 AS, Ålesund (NO)

(72) Inventors: Thomas Øvrevoll Pedersen, Ålesund (NO); Lars Reidar Eschen Brekke, Hareid (NO)

(73) Assignee: Seastate 7 AS, Alesund (NO)

( * ) Notice: Subject to any disclaimer, the term of this patent is extended or adjusted under 35 U.S.C. 154(b) by 0 days.

(21) Appl. No.: 15/529,143

(22) PCT Filed: Nov. 27, 2015

(86) PCT No.: PCT/NO2015/050229

§ 371 (c)(1),
(2) Date: May 24, 2017

(87) PCT Pub. No.: WO2016/085353

PCT Pub. Date: Jun. 2, 2016

(65) Prior Publication Data

US 2017/0259884 A1 Sep. 14, 2017

(30) Foreign Application Priority Data

Nov. 28, 2014 (NO) ..... 20141439

(51) Int. Cl.
*B63B 3/14* (2006.01)
*B63B 19/19* (2006.01)
*B63B 35/44* (2006.01)

(52) U.S. Cl.
CPC ..... *B63B 3/14* (2013.01); *B63B 19/19* (2013.01); *B63B 2003/147* (2013.01); *B63B 2035/448* (2013.01)

(58) Field of Classification Search
CPC ..... B63B 3/14; B63B 19/19
(Continued)

(56) References Cited

U.S. PATENT DOCUMENTS 4,272,059 A * 6/1981 Noerager ..... E21B 7/128 166/355
6,273,018 B1 * 8/2001 Gottsche ..... B63B 9/065 114/264

(Continued)

FOREIGN PATENT DOCUMENTS

WO WO 97/18987 5/1997
WO WO 9718987 A1 * 5/1997 ..... B63B 3/54

(Continued)

*Primary Examiner* — S. Joseph Morano
*Assistant Examiner* — Jovon Hayes
(74) *Attorney, Agent, or Firm* — Buchanan Ingersoll & Rooney PC

(57) ABSTRACT

A moon pool control device (5) for a marine vessel (1) comprises one or more closure members (8*a,b*) arranged for movement in the moon pool, between a moon pool closing position in a region of the moon pool opening (7), a moon pool open position, and a retracted position, and guiding means (14*a,b;* 15*a,b;* 17*a,b;* 18*a,b*) and motive means (9*a,b;* 10*a,b;* 22) configured for moving the closure member between said positions. In a particular embodiment, a pair of closure members (8*a,b*) and corresponding guiding means (14*a,b;* 15*a,b;* 17*a,b;* 18*a,b*) and motive means (9*a,b;* 10*a,b;* 22) are arranged on opposite lateral sides of the moon pool and configured to cooperate to close the opening (7) when both closure member s are in the closing position. The closure members comprise a continuous surface that forms a fluid barrier. The closure members may be retrieved onto the deck of the vessel.

11 Claims, 7 Drawing Sheets

(58) Field of Classification Search
USPC ..... 114/230, 165 R
See application file for complete search history.

(56) References Cited

U.S. PATENT DOCUMENTS

| | | | | |
|---|---|---|---|---|
| 6,561,112 | B1 * | 5/2003 | Benson | B63B 3/14 114/230.1 |
| 9,422,035 | B2 * | 8/2016 | Bauduin | B63B 21/508 |
| 9,540,076 | B1 * | 1/2017 | Trail | B63B 27/08 |

FOREIGN PATENT DOCUMENTS

| | | | | |
|---|---|---|---|---|
| WO | WO 2012/146622 | | 11/2012 | |
| WO | WO 2012146622 | A1 * | 11/2012 | B63B 35/4413 |
| WO | WO 2013/167805 | | 11/2013 | |

* cited by examiner

MOON POOL CONTROL DEVICE FOR A MARINE VESSEL

CROSS-REFERENCE TO RELATED APPLICATIONS

This application is a U.S. National Stage Application pursuant to 35 U.S.C. § 371 of International Patent Application PCT/N02015/050229, filed on Nov. 27, 2015, and published as WO 2016/085353 on Jun. 2, 2016, which claims priority to Norway Patent Application 20141439, filed on Nov. 28, 2014, all of which are incorporated herein by reference in their entireties for all purposes.

FIELD OF THE INVENTION

The invention concerns the field of marine vessels having a channel through its hull with an opening into the sea, such as a moon pool. More particularly, the invention concerns a device for controlling such opening, as set out by the preamble of claim 1.

BACKGROUND OF THE INVENTION

Several types of marine vessels are equipped with an opening in the base or bottom of the hull, that provides access to the water underneath the vessel. Typically, this opening extends from a deck on the vessel, through the hull, and to a portion of the hull bottom. An opening of this type is commonly referred to as a "moon pool".

Moon pools are common in floating platforms that are used for drilling, production and/or maintenance of subsea oil and gas wells and associated subsea equipment. Drill strings, completion equipment, and various other tool and devices, are lowered into the water through the moon pool.

Moon pools are also common in drill ships and in diving support vessels and other offshore support vessels, including ships that are used for deploying and controlling subsea remotely operated vehicles (ROVs).

The relative movement between the water and the vessel generates turbulent flow in and around the moon pool; particularly if the vessel is a ship moving though the water at cruising speeds. These turbulent flows may be very strong and hence be the source of considerable drag forces acting on the hull. The industry is therefore seeking means to reduce the turbulence, and hence the drag forces, caused by the ship's moon pool.

Another disadvantage with open moon pools is the so-called "piston effect", in which the oscillating seawater column inside the moon pool generates a forced airflow out of and into the moon pool. This airflow may be uncomfortable and even dangerous to personnel in the vicinity of the moon pool. Another problem with open moon pools on vessels operating in arctic waters is interference with ice floe and ice chunks. These objects may enter the moon pool where they could cause damage to equipment and structures, and jeopardize operations through the moon pool.

An overview of the prior art is provided in the following.

U.S. Pat. No. 6,503,022 B1 describes a vessel having a moon pool positioned in the centre of the vessel. A moon pool plug is adapted to have controllable positive and negative buoyancy. The plug has a top, a cover, a bottom, a first angled side, a second angled side, a third angled side, a fourth angled side; first plates disposed traversely across the bottom of the plug; and second plates disposed perpendicular to said first plates across the bottom of the plug. There is a water valve for permitting sea water to egress from the plug; an air valve for permitting air to be pumped into the plug. There is a guiding device secured to the plug to guide the plug into the moon pool. There is a hoist secured to the plug to lift the plug into the desk of the vessel.

US 2014/0202371 A1, discloses a drillship having a vortex suppression block with a recessed flow stabilizing part in a moon pool. The flow stabilizing section is formed so that a bottom of the vortex suppression block that protrudes from a bottom of a hull toward a stern in the moon pool is recessed in an upward direction of the hull to stabilize a flow in the moon pool and reduce a variation in resistance of the drillship. The flow stabilizing section is formed by partly recessing the bottom of the vortex suppression block toward an upper portion of the hull.

U.S. Pat. No. 8,770,124 B2 discloses a device for diminishing flow resistance in a moon pool. The device includes a guide structure having a lattice shape. The guide structure includes horizontal guide plates, guide ramps, longitudinal reinforcing beams and a hinge axis. The horizontal guide plates are spaced apart from each other along a longitudinal direction of a hull and arranged in rows along a lateral direction of the hull. The guide ramps are arranged in rows along the lateral direction and coupled to the respective horizontal guide plates. Front ends of the guide ramps are inclined upwards towards a bow side of the hull and spaced apart from rear ends of the adjacent fore horizontal guide plates. The longitudinal reinforcing beams support the horizontal guide plates and the guide ramps. The lattice guide structure is rotated around the hinge axis towards a transit position or a working position.

KR 2010 0069983 discloses an open-type door for reducing resistance of a moon pool of a drilling ship and a marine structure is provided to minimize damage to due to vibration. The open-type door comprises first and second doors which are installed on two sides of the bottom of the moon pool. One end of the first and the second door is connected to the hull by a hinge connected to a motor through a chain. The hinge connected to the chain is rotated together with the motor, thereby opening and closing the doors.

KR 2010 0020613 discloses a resistance reduction apparatus for a moon pool, to reduce vortex flow caused in the moon pool by effectively interrupting a flow field into the moon pool. A first rod and a second rod are located separate from each other at the entrance of a moon pool. A grid is located between the first rod and the second rod, with both ends connected to the first and the second rod. The first rod is fixed to one side of the moon pool entrance and the second rod can move close to the first rod.

JP H 08 119190 discloses a device to reduce resistance by generation of eddy currents in a lower end aperture part of a moon pool for a floating structural body having a moon pool formed of cylindrical surrounding walls penetrating from an aperture edge of an upper deck to an aperture edge of an outer plate of a bottom part. In an aperture part at a lower end of a moon pool formed of cylindrical surrounding walls penetrating from an aperture deck of an upper deck to an aperture edge of an outer plate of a bottom plate, a cover-shaped structural body pivotally attached through a hinge to be opened/closed is composed of a number of vertical plates to part the inside of the aperture part combined like a grid in such a way that generation of eddy currents can be prevented while allowing going in/out of water at the aperture part in the closed condition of the structural body in navigation.

JP S 61 132495 discloses a device for improving propulsion efficiency, by installing a horizontal roll wound with a canvas at the lower edge of one inner wall surface of a moon pool and freely laying the canvas towards the opposed inner wall surface and closing the moon pool during navigation. A horizontal roll which can be revolved normally and reversely is installed at the lower edge of one inner wall surface of a moon pool, and a canvas is wound. A wire for pulling in the horizontal direction towards the opposed inner wall surface is engaged with the outer side edge part of the wound canvas, and connected to a taking-up apparatus on a deck, and the canvas can be laid towards the opposed inner wall surface.

The present invention represents an improvement over the prior art devices and offer additional advantages.

SUMMARY OF THE INVENTION

The invention is set forth and characterized in the main claim, while the dependent claims describe other characteristics of the invention.

It is thus provided a moon pool control device for a marine vessel having a moon pool extending between a deck on the vessel and an opening in a hull portion of the marine vessel, characterized by one or more closure members arranged for movement in the moon pool, between a moon pool closing position in a region of the moon pool opening, a moon pool open position, and a retracted position in a region of said deck, and guiding means and motive means configured for moving the closure member between said positions.

is The guiding means may extend between a region of said opening and a region of said deck.

In one embodiment, a first set of guiding means are configured to provide support for the closure member when the closure member is in the closing position. The closure member may comprise locking structures configured for releasable interaction with mechanical locks when the closure member is in the moon pool closing position.

In one embodiment, the moon pool control device comprises a carrier hingeably connected to each closure member, and wherein the carrier is movably connected to a second set of guiding means and to the first motive means.

The closure member may be hingeably connected to the carrier at a first end, and a second, opposite, end comprises in one embodiment a leading edge. In one embodiment, the leading edge comprises a recessed portion.

In one embodiment, a pair of closure members and corresponding guiding means and motive means are arranged on opposite lateral sides of the moon pool and configured to cooperate to close the opening when both closure members are in the closing position.

The closure member comprises a continuous surface, preferably of a metal material, that forms a fluid barrier.

Locking and support means may be arranged in a region of the opening and having support means configured for supporting each closure member in a region of the closure member leading edge.

The invented apparatus eliminates, or reduces substantially, turbulent flow—and hence drag, and eliminates, or reduces substantially, the piston effect. The invented apparatus also provides thermal insulation, in that it prevents cold air from entering the main deck and enclosed compartments (e.g. ROV hangar), and prevents ingress of water-borne objects, such as ice floe and ice chunks, into the moon pool. It protects equipment in the moon pool from slamming forces that—in an open moon pool—are caused by the moving water column. The hatches may easily be retrieved onto deck for maintenance and repair, etc. The moon pool bottom opening may be closed during (e.g.) ROV operation, save for a comparably small hole allowing the umbilical to pass through. This hole, i.e. the recessed portions in the closure members, may be adjustable.

BRIEF DESCRIPTION OF THE DRAWINGS

These and other characteristics of the invention will become clear from the following description of a preferential form of embodiment, given as a non-restrictive example, with reference to the attached schematic drawings, wherein.

DETAILED DESCRIPTION OF A PREFERENTIAL EMBODIMENT

Figure 1:
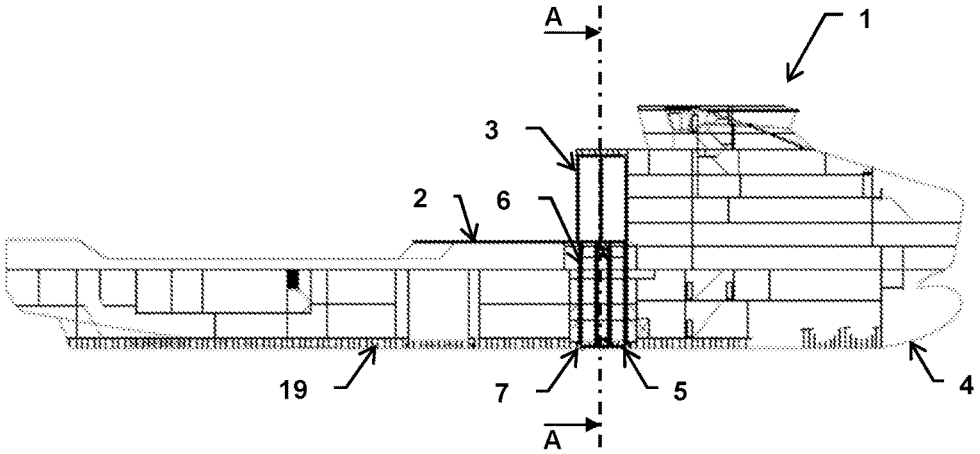
FIG. 1 is a side view of a ship being equipped with an embodiment of the invented device.

The following description may use terms such as "horizontal", "vertical", "lateral", "back and forth", "up and down", "upper", "lower", "inner", "outer", "forward", "rear", "top", "bottom", etc. These terms generally refer to the views and orientations as shown in the drawings and that are associated with a normal use of the invention. The terms are used for the reader's convenience only and shall not be limiting.

Figure 2:
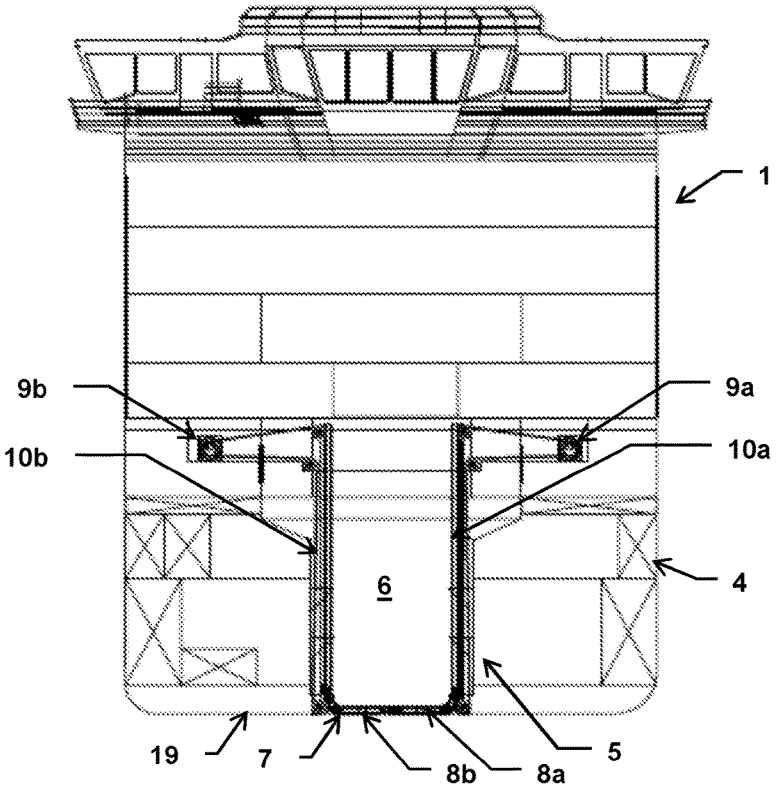
FIG. 2 is a sectional view towards the section A-A shown in FIG. 1.

FIG. 1 shows the invented device 5 installed on a ship 1 having a moon pool 6 extending through the ship's hull 4 from an upper deck 2 to the hull bottom 19. A hangar 3 (e.g. for an ROV) is arranged above the moon pool. Referring additionally to FIG. 2, the moon pool bottom opening 7 is closed by a pair of hatches 8*a,b*, substantially flush with the hull bottom, in a manner which will be described in detail below. FIG. 2 also shows a pair of winches 9*a,b*, and sets of wires 10*a,b* extending between the each of the winches and a respective hatch.

Figure 3:
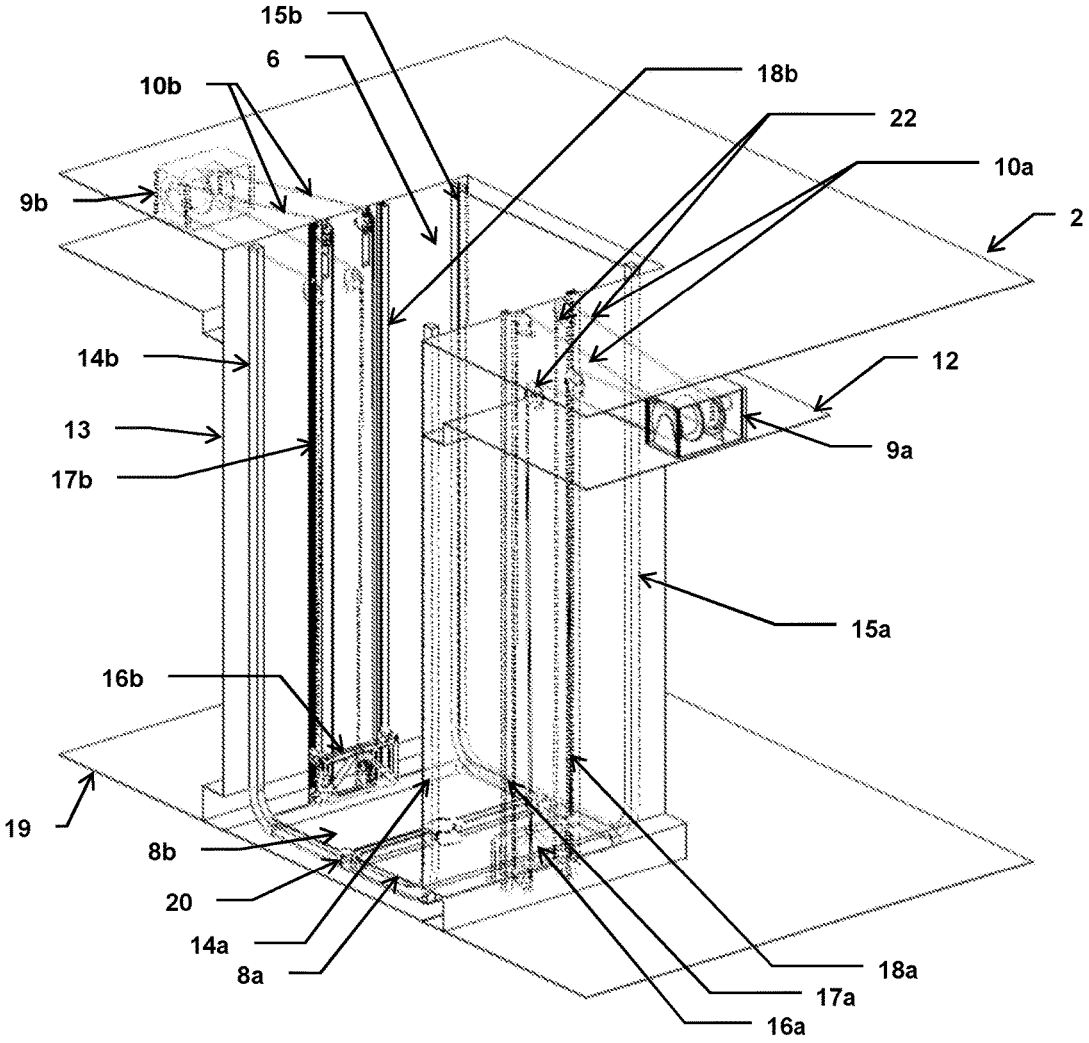
FIG. 3 is a perspective cut-out, and partly transparent, drawing of the invented device, with the moon pool hatches in a closed position.
Figure 4:
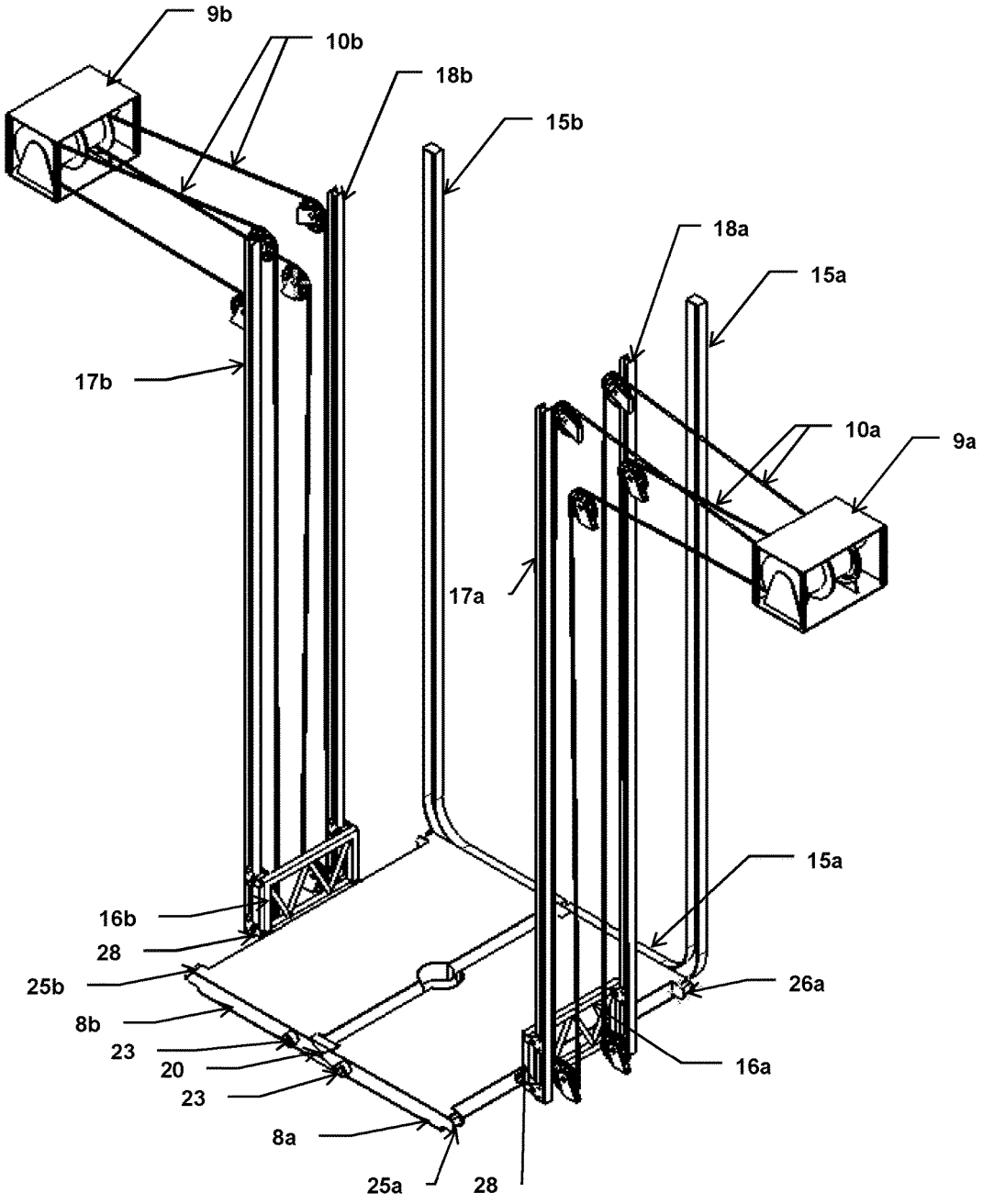
FIG. 4 is in many respects similar to FIG. 3, except that some components have been removed to illustrate certain aspects of the invention.
Figure 6:
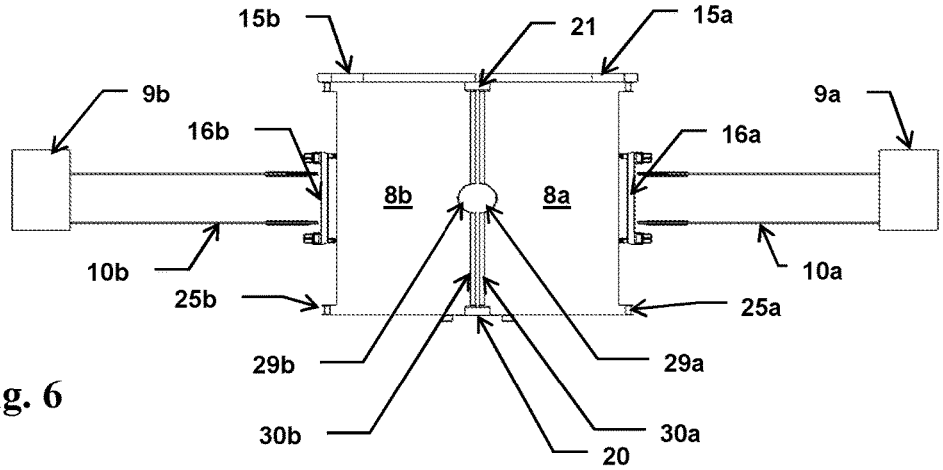
FIG. 6 is a top view of the device as illustrated in FIG. 4.
Figure 7:
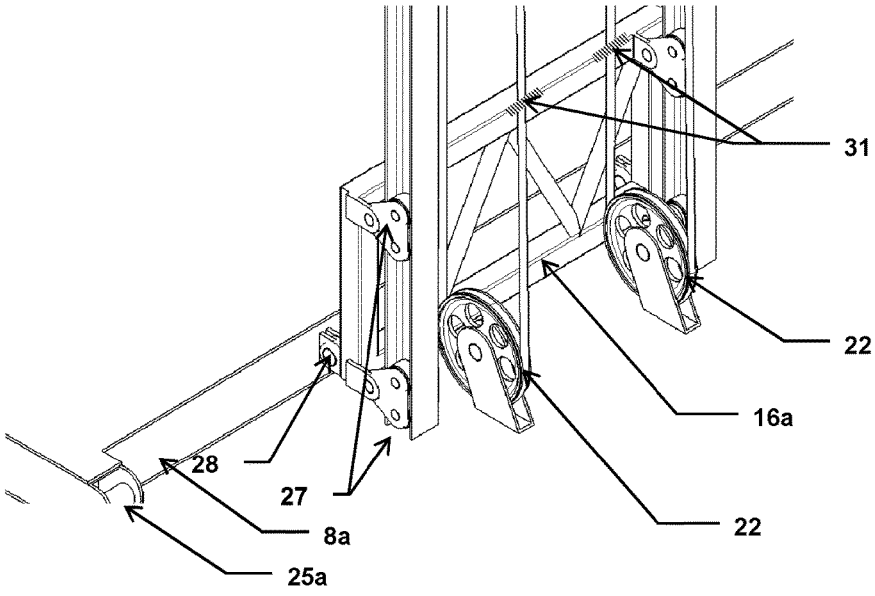
FIG. 7 is a perspective view of a portion of the lower right-hand corner of FIG. 4.

The invented device is shown in more detail in FIG. 3. The winches 9*a,b*, which in the illustrated embodiment is arranged on a lower deck 12, immediately below the main deck 2, are connected via respective pairs of wires 10*a,b* to respective frame structures 16*a,b*, referred to hereinafter as carriers. Referring additionally to FIG. 7, each respective wire pair extends between its winch, via a plurality of sets of pulleys 22, and a respective attachment point 31 on the respective carrier 16*a,b*. As shown in the figures, pulleys are arranged on the (inside) hull bottom, near the moon pool opening, on the lower deck 12 and on the moon pool wall 13. Referring additionally to FIGS. 4, 6 and 7, where certain components have been removed in order to better illustrate other components, each carrier 16*a,b* is movably supported via rollers 27 by a pair of carrier guides 17*a*, 18*a* and 17*b*, 18*b* extending between the moon pool bottom opening and a region of the main deck 2 or lower deck 12. Each winch is thus capable of moving its respective carrier 16*a,b*—supported and guided by the carrier guides—up and down in the moon pool. The power supply, control, and operation of the winches are per se known in the art and need therefore not be described in more detail here.

A first moon pool hatch 8*a* is hinge-connected to the first carrier 16*a* via a pair of bolts 28. A second moon pool hatch 8*b* is hinge-connected to the second carrier 16*b* via a pair of bolts 28. The hatches 8*a,b* are shaped and dimensioned to close the moon pool bottom opening 7 when they are in the positions shown in e.g. FIGS. 3 to 7. The hatches are made of a strong and durable material, such as steel, and comprise preferably welded box structures to provide strength and stiffness.

Figure 10:
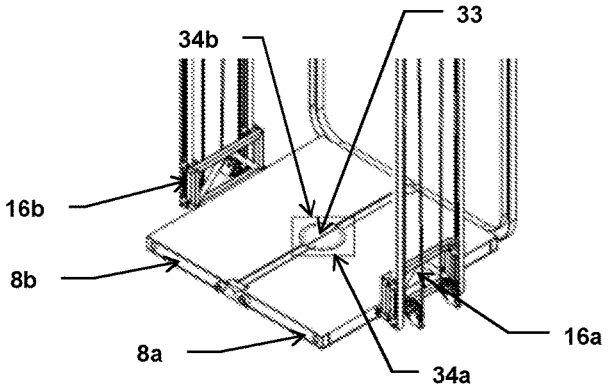
FIG. 10 corresponds to the lower portion of FIG. 4, and shows an alternative configuration of the moon pool hatches.

Each hatch 8*a,b* comprises rear portion (which is hinge-connected to the carrier via the bolts 28) and a forward portion, preferably comprising a gasket 30*a,b*, as illustrated by e.g. FIG. 6. The forward portion of each hatch comprises a recessed portion 29*a,b* arranged and configured such that a hole is formed when the hatches are in the closed position. Thus, the hatches 8*a,b* form a firm barrier at the moon pool bottom opening, preventing ingress of seawater. The hole may be temporarily plugged, if desired, by a plug device 33, illustrated schematically in FIG. 10. The plug device 33 may comprise means for it to be lowered from and retrieved to the decks 2, 13. FIG. 10 also indicates optional adjustments means 34*a,b*, whereby the hatch recesses 29*a,b* (and hence the hole size) may be adjusted, for example remotely from a location on deck 2.

Figure 5:
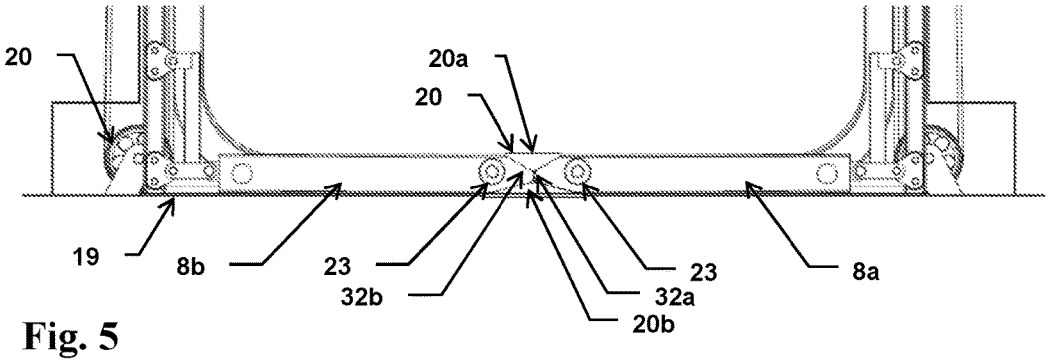
FIG. 5 is a side view of the lower portion of the device as illustrated in FIG. 4.

Each hatch 8*a,b* is supported and guided in a region of its forward portion via respective pairs of rollers 23 in respective guide structures 14*a,b*, 15*a,b*, hereinafter referred to as hatch guides. A hatch guide 14*a,b*, 15*a,b* is arranged generally in each corner of the moon pool. Thus, a first pair of hatch guides 14*a*, 15*a* is arranged on a right-hand side of the moon pool, and a second pair of hatch guides 14*b*, 15*b* is arranged on a left-hand side of the moon pool (as seen in FIG. 3). Each hatch guide has a first portion which extends along the (inside) hull bottom from a respective central hatch lock 20, 21, a second portion which extend the length (i.e. height) of the moon pool to a region of the main and lower decks, and a curved portion interconnecting the first and second portion. The hatch locks 20, 21 are arranged one on each side of the moon pool bottom opening and are configured to receive a hatch leading edge 32*a,b*. Referring to FIG. 5, the hatch locks comprise an upper abutment portion 20*a*, preventing upward movement of the hatches when they are in the closed position, and a lower abutment portion 20*b*, preventing downward movement of the hatches when they are in the closed position.

Figure 11:
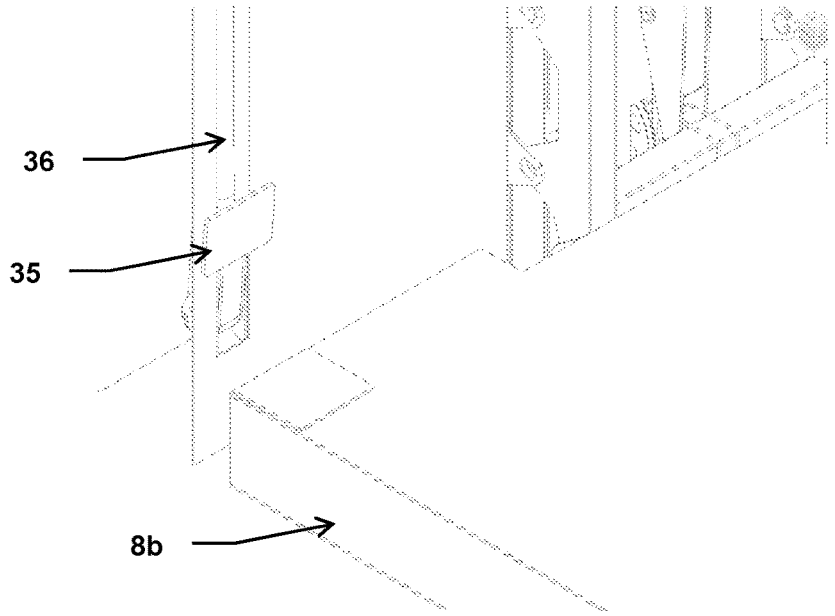
FIG. 11 illustrates a locking clamp in an open (unlocked) position.
Figure 12:
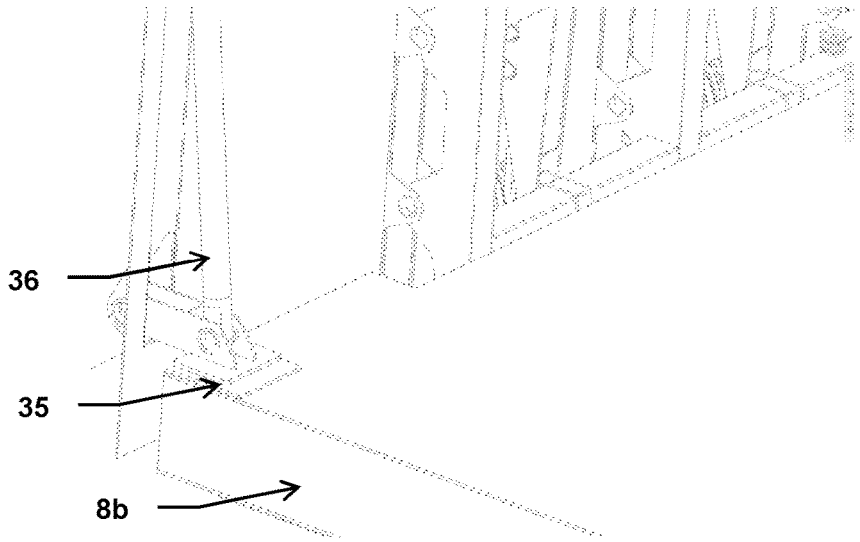
FIG. 12 illustrates the locking clamp in a locked (clamping) position.

It should be understood that additional mechanical locks, as known in the art per se, may be provided in the moon pool to releasably engage with locking interface structures 25*a*, 26*a*, 25*b*, 26*b* arranged at the hatches' rear portion when the hatches are in the closed position. FIG. 11 and FIG. 12 illustrate one such variant, in which a movable locking clamp 35 is provided in the moon pool side to press down (and clamp) the hatch 8*b* when it is in the closed position. The clamp 35 is operated via a known actuation and control means (not shown), via e.g. a push-rod 36. FIG. 11 shows the locking clamp 11 in an open (unlocked) position, and FIG. 12 shows the locking clamp 35 in a locked (clamping) position.

Figure 8:
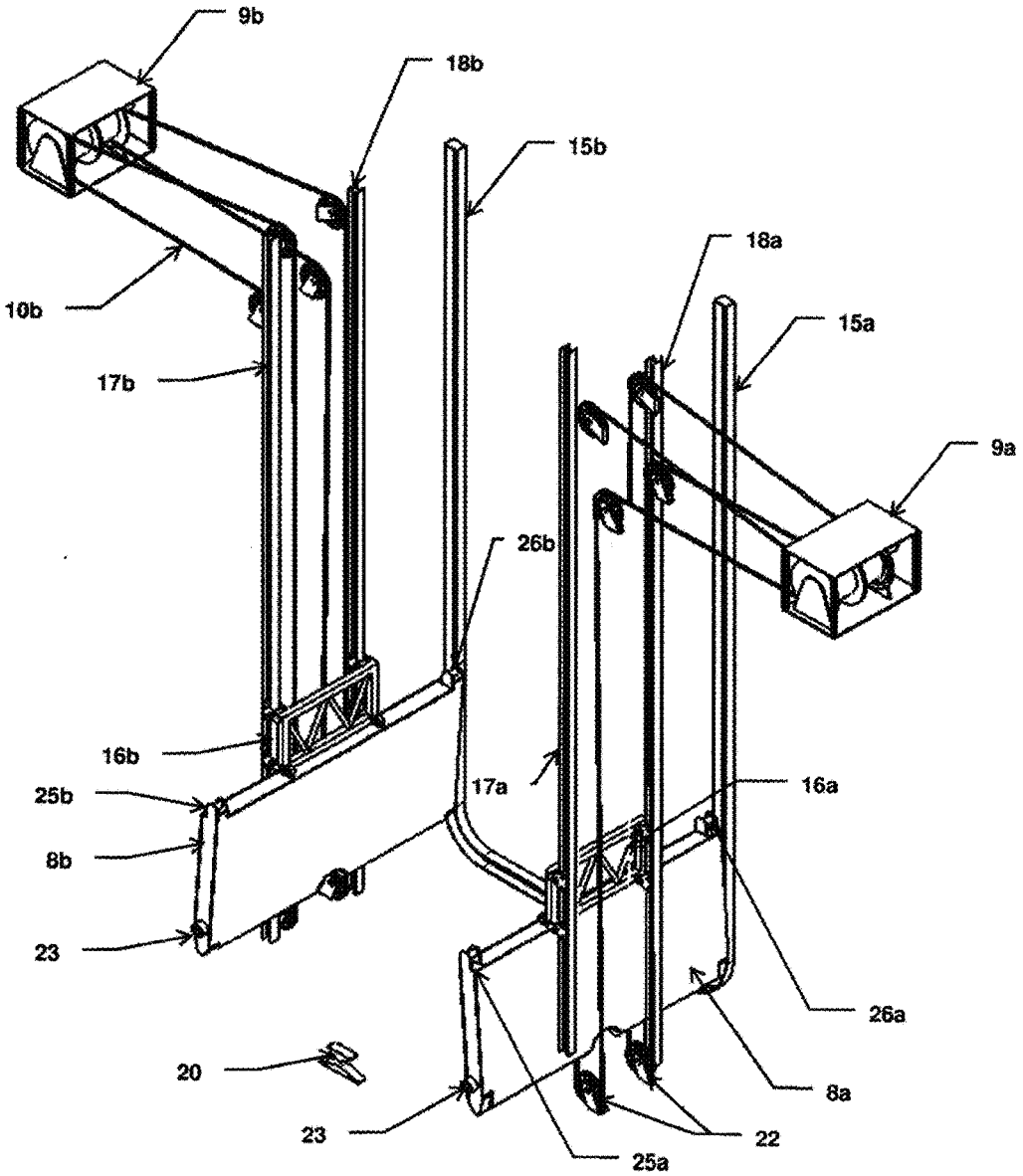
FIG. 8 is in many respects similar to FIG. 4, showing the moon pool hatches in an open position.
Figure 9:
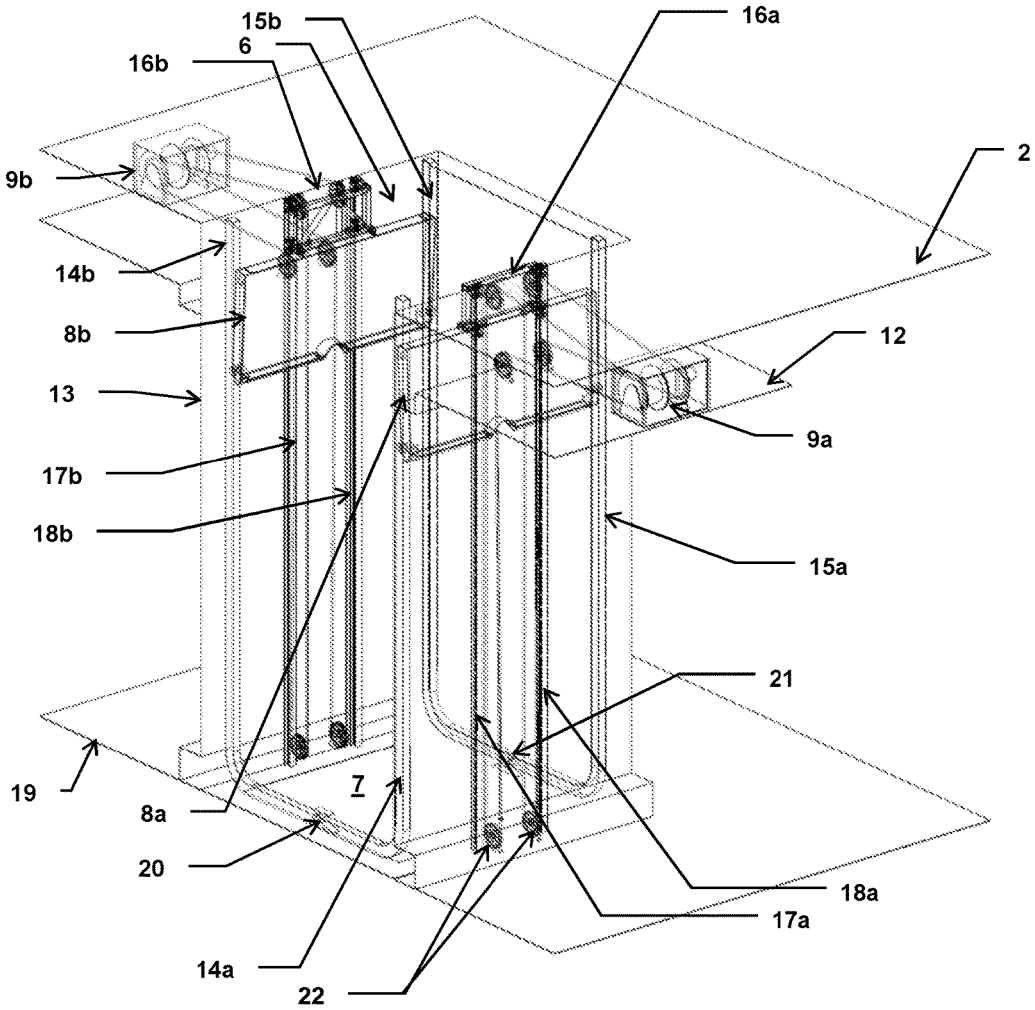
FIG. 9 is a perspective cut-out, and partly transparent, drawing of the invented device, with the moon pool hatches in an open and retracted position.

In operation, each of the hatches 8*a,b* may be moved between:

a moon pool closing position (shown in e.g. FIG. 3);
a moon pool opening position (shown in FIG. 8), and
a retracted position (shown in FIG. 9)

Although not illustrated, it should be understood that extensions may be connected to the upper end of each carrier guide, whereby the carriers may be hoisted further up (e.g. by a crane) such that the carriers and hatches are easily accessible for service personnel working on the deck 2.

In should be understood that the hatches may be operated individually or simultaneously, for example having one hatch in the moon pool closing position and the other hatch in the open or retracted position. The moon pool bottom opening 7 may thus selectively be fully closed, partly open, and fully open. When both hatches are in the closing position, cables and umbilicals may be run through the hole formed by the recessed portions 29*a,b*. Thus, an ROV may be operated from the ship even when the hatches are in the closed position, while the piston effect is avoided and the above mentioned turbulence-induced drag is virtually eliminated.

When the hatches are in the retracted position (FIG. 9) they are easily accessible from the main deck 2 or the lower deck 12, and may be removed from their respective carrier for repair, refurbishment or replacement. The carriers may also be disconnected from their guides in this position. Although not illustrated, it should be understood that the carrier guides and hatch guides may be extended beyond the main deck, if desirable or practical.

It should be understood that the wire-and-winch arrangement described above may be replaced by other motive means, such as chains, sprockets, rack-and-pinion, without deviating from the scope of the invention. The moon pool may also be furnished with panels and covers in order to protect the wires, pulleys, etc.

Although the invented hatch device is particularly useful in a moon pool on an ROV handling ship, it should be understood that the invention is applicable to any moon pool or similar construction on a marine vessel.

Although the invention has been described as having a pair of hatches of the same size that together close the moon pool bottom opening, it should be understood that the invention also applies to embodiments where the hatches have different sizes. The invention also applies to an embodiment having only one hatch. In that case the hatch guides are extended on both sides of the moon pool bottom opening and the singular hatch preferably extends across the entire moon pool bottom opening when in the closing position.

The invention claimed is:

1. A moon pool control device (5) for a marine vessel (1) having a moon pool (6) extending between a deck (2, 12) on the vessel and an opening (7) in a hull portion (4) of the marine vessel, characterized by one or more closure members (8*a,b*) arranged for movement in the moon pool, between a moon pool closing position in a region of the moon pool opening (7), a moon pool open position, and a retracted position in a region of said deck (2, 12), and guiding means (14*a,b*, 15*a,b*, 17*a,b*, 18*a,b*) and motive means (9*a,b*, 10*a,b*, 22) configured for moving the closure member between said positions.

2. The moon pool control device of claim 1, wherein the guiding means (14*a,b*, 15*a,b*, 17*a,b*, 18*a,b*) extend between a region of said opening (7) and a region of said deck (2, 12).

3. The moon pool control device of claim 1, wherein a first set of guiding means (14*a,b*, 15*a,b*) are configured to provide support for the closure member when the closure member is in the closing position.

4. The moon pool control device of claim 1, wherein the closure member (8*a,b*) comprises locking structures (25*a*, 26*a*, 25*b*, 26*b*) configured for releasable interaction with mechanical locks (35, 36) when the closure member is in the moon pool closing position.

5. The moon pool control device of claim 1, further comprising a carrier (16*a,b*) hingeably connected to each closure member (8*a,b*), and wherein the carrier is movably connected to a second set of guiding means (17*a,b*, 18*a,b*) and to the first motive means (10*a,b*).

6. The moon pool control device of claim 5, wherein the closure member is hingeably connected to the carrier at a first end, and a second, opposite, end comprises a leading edge (32*a,b*).

7. The moon pool control device of claim 6, wherein the leading edge comprises a recessed portion (29*a,b*).

8. The moon pool control device of claim 1, wherein a pair of said closure members (8*a,b*) and corresponding said guiding means (14*a,b*, 15*a,b*, 17*a,b*, 18*a,b*) and said motive means (9*a,b*, 10*a,b*, 22) are arranged on opposite lateral sides of the moon pool and configured to cooperate to close the opening (7) when both closure members are in the closing position.

9. The moon pool control device of claim 1, wherein the closure member comprises a continuous surface, that forms a fluid barrier.

10. The moon pool control device of claim 8, further comprising locking and support means (20, 21) arranged in a region of the opening (7) and having support means (20*a,b*) configured for supporting each closure member (8*a,b*) in a region of the closure member leading edge (32*a,b*).

11. The moon pool control device of claim 9, wherein the continuous surface is of a metal material.

* * * * *